US010961715B2

(12) United States Patent
Hurst

(10) Patent No.: US 10,961,715 B2
(45) Date of Patent: Mar. 30, 2021

(54) TWIST RESISTANT ROOF STRUCTURE

(71) Applicant: Mario Hurst, Brisbane (AU)

(72) Inventor: Mario Hurst, Brisbane (AU)

( * ) Notice: Subject to any disclaimer, the term of this patent is extended or adjusted under 35 U.S.C. 154(b) by 0 days.

(21) Appl. No.: 16/559,067

(22) Filed: Sep. 3, 2019

(65) Prior Publication Data

US 2021/0062513 A1 Mar. 4, 2021

(51) Int. Cl.
*E04D 13/16* (2006.01)

(52) U.S. Cl.
CPC ..... *E04D 13/1625* (2013.01)

(58) Field of Classification Search
CPC ..... E04D 13/1625
USPC ..... 52/404.3
See application file for complete search history.

(56) References Cited

U.S. PATENT DOCUMENTS 2,216,319 A * 10/1940 McGee ..... E04B 2/766 52/292
4,346,543 A * 8/1982 Wilson ..... E04D 3/3602 52/404.2
4,384,437 A * 5/1983 Coles ..... E04D 13/1637 52/404.3
4,429,508 A * 2/1984 Sizemore ..... E04D 3/3608 52/410
4,651,489 A * 3/1987 Hodges ..... E04D 3/3602 52/409
5,058,352 A * 10/1991 Loiselle ..... E04B 1/7654 52/404.2
8,122,667 B2 * 2/2012 Ferge ..... E04D 3/361 52/544
8,627,628 B2 * 1/2014 McClure ..... E04D 13/1618 52/404.3
9,580,909 B2 * 2/2017 Hostetler ..... E04D 13/1618
9,725,903 B2 * 8/2017 Hostetler ..... E04D 3/3602

FOREIGN PATENT DOCUMENTS

AU 2018901464 5/2018
FR 2614053 A1 * 10/1988 ..... E04D 3/352

* cited by examiner

*Primary Examiner* — Jeanette E Chapman
(74) *Attorney, Agent, or Firm* — DeLio Peterson & Curcio LLC; Thomas E. Ciesco

(57) ABSTRACT

The present invention relates to a roof structure comprising support members. Depth locators are provided for fastening to the support members to locate a desired depth of bridge members. The bridge members extend between the support members at the desired depth. A safety barrier is provided for being supported by the bridge members. Each depth locator may include a folded sheet bracket which advantageously resists twisting when fastened to the support members with a threaded depth locator fastener driven by a rattle gun.

15 Claims, 7 Drawing Sheets

TWIST RESISTANT ROOF STRUCTURE

BACKGROUND OF THE INVENTION

1. Field of the Invention

The present invention relates generally to a building roof structure. The present invention also relates to a method of building a roof structure.

2. Description of Related Art

The reference to any prior art in this specification is not, and should not be taken as an acknowledgement or any form of suggestion that the prior art forms part of the common general knowledge.

A typical building roof structure includes a plurality of support members and a roofing layer which is secured to and supported by the support members. The support members are typically provided by purlins which are secured to one or more rafters, and the roofing layer is usually provided by a plurality of tiles, roof panels, shingles, or the like which are secured to and supported by the purlins.

Sometimes the roof structure will include a fall protection system for preventing a person or other objects from falling through the roof structure. The fall protection system typically comprises a safety barrier in the form of safety mesh or the like which is placed on top of the purlins and which is secured to the purlins.

A layer of thermal insulation is often included in the roof structure to inhibit the transfer of heat through the roof structure. The layer of insulation is typically placed on top of the purlins, and the roofing layer is then placed on top of the insulation. This tends to compress areas of the insulation which are located between the roofing layer and the purlins.

Compressing the insulation can be problematic in that the compressed areas of the insulation usually do not perform at an optimum level. In other words, compressing the insulation can compromise the thermal insulating properties of the insulation. If the performance of the insulation is compromised, the energy efficiency of the building can be impaired so that more energy is required to cool or heat the interior of the building to maintain it at a desired temperature.

In order to improve the energy efficiency of new buildings, Section) of the Building Code of Australia ("BCA") was introduced by the Australian Building Codes Board. Section) of the BCA requires the roof structure of a new building to have a minimum R-value of 3.2, and stipulates that, in order to achieve this, there must be a recovery air gap between the roofing layer and the insulation so that the insulation is not compressed between the purlins and the roofing layer.

U.S. Pat. No. 4,047,346 (Alderman) and U.S. Pat. No. 4,379,381 (Holcombe) disclose thermally insulated roof structures which include an air gap between a roofing layer and a thermal insulation layer.

Alderman discloses an insulated roof structure formed on an industrial building by mounting a support framework on the purlins of the partially completed roof structure and moving the framework along the length of the purlins. A reel of wire mesh and a reel of sheet material are carried by the framework over each of the spaces between adjacent ones of the purlins, and the reels are progressively unrolled, and the layers of wire mesh and sheet material are applied to the spaces between the purlins as the support framework moves. Additional insulation can be blown upon or otherwise applied to the sheet material to fill the spaces between the purlins, and hard sheets of roofing material are applied to the purlins as the support framework progresses across the structure.

A central web of each purlin of the insulated roof structure disclosed by Alderman includes a plurality of openings. The roof structure also includes a plurality of support straps. Each support strap is threaded through one of the openings in each purlin. The support strap is placed under tension so that it extends in a substantially flat plane between adjacent ones of the purlins.

Being straps, the support straps are quite flexible. Consequently, the support straps are not particularly well-suited to spacing the purlins apart from each other, or to maintaining the spacing between the purlins.

Each of the support straps is inhibited from being withdrawn from the opening through which it extends by a retaining clip which is wedged in the opening so as to form a friction connection between the purlin and the support strap.

The layers of wire mesh which are applied to the spaces between the purlins are placed on the support straps. The support straps support the mesh at spaced intervals along the lengths of the purlins, and tension is applied to the mesh so as to prevent the mesh from sagging extensively between adjacent ones of the support straps.

The sheet material is placed upon the mesh, and a quantity of heat insulation material is disclosed inserted in the spaces between adjacent ones of the purlins and onto the sheet material. The insulation material can be in the form of blocks of solid material, sheets of material, loose material, or material that was initially loose when placed in the space but sprayed or otherwise mixed with adhesive as or after being inserted into the spaces so as to become substantially rigid.

An additional sheet of insulation material is applied to the top surface of the upper flange of each of the purlins, and the hard sheets of roofing material are placed on the sheet insulation material and connected to the purlins by self-tapping screws or other fasteners.

The additional sheet of insulation material functions to reduce the transfer of heat between the hard sheets of roofing material and the purlins, and the insulation material in the spaces between adjacent ones of the purlins function to inhibit the transfer of heat between inside the building and the hard sheets of roofing material by means of convection and radiation.

FIG. 1 of Alderman depicts an air gap which separates the sheets of roofing material from the heat insulation material which is supported by the sheet material.

Holcombe discloses an insulation system for a roof structure which includes a semi-rigid insulation blanket overlying a support structure across roof purlins and having additional insulation material filling a U-shaped trough created by the blanket between adjacent purlins. The semi-rigid insulation blanket is notched by the manufacturer at predetermined points to enable the blanket to easily and securely fold over and around the support structure and roof purlins.

The support structure of the Holcombe insulation system includes main support brackets which extend between and rest on top of the purlins, and longitudinal support brackets which extend between and rest on top of the main support brackets. The main support brackets and the longitudinal support brackets include fastening holes for receiving plastic snap-in fasteners which secure the main support brackets to the purlins and which secure the longitudinal support brackets to the main support brackets.

FIG. 2 of Holcombe depicts an air gap separating the roof panel and an insulation bat of the roof structure.

AU2009233686 discloses a known building roof structure. Applicant has perceived the need for an alternative roof structure.

SUMMARY OF THE INVENTION

According to one aspect of the present invention there is provided a roof structure comprising:

support members;

depth locators for fastening to the support members to locate a desired depth of bridge members;

the bridge members for extending between the support members at the desired depth; and a safety barrier for being supported by the bridge members.

Each depth locator may include a folded sheet bracket which advantageously resists twisting when fastened to the support members with a threaded depth locator fastener driven by a rattle gun.

Each depth locator may include a lip for aligning with a roof of a support member. Each depth locator may include a back for aligning with a support member and a pair of flanges extending from either side of the back. The flanges may receive a bridge member. The back and the support member may define co-incident holes for receiving a depth locator fastener. The depth locator fastener may be a bolt.

The structure may further include a pair of bridge fasteners extending through the flanges to fasten a bridge member to a depth locator. Each bridge fastener may be a rivet.

Preferably, a safety barrier is supported by the bridge members and an insulating layer rests directly on the safety barrier.

A roofing layer may be supported by the support. The roofing layer and the insulating layer may be separated from each other by an air gap.

According to another aspect of the present invention, there is provided a roof-structure depth-locator for fastening to a support member to locate a desired depth of a bridge member, the locator including a folded sheet bracket.

According to another aspect of the present invention, there is provided a method of building a roof structure, the method comprising the steps of:

(i) extending bridge members between adjacent support members at a desired depth located by depth locators fastened to the support members; and (ii) supporting a safety barrier with the bridge members.

The method may further involve (iii) supporting an insulating layer with the safety barrier. The method may further involve (iv) supporting a roofing layer with the support members such that the roofing layer and the insulating layer are separated from each other by an air gap.

By extending between the support members and being secured relative to the support members, the bridge members increase the rigidity and the strength of the roof structure.

The presence of the air gap between the insulating layer and the roofing layer means that the roof structure is able to comply with the part of Section J of the BCA which requires the presence of such an air gap.

The bridge members form part of a fall protection system which also comprises the safety barrier because the bridge members support the safety barrier.

The support members may be of any suitable type. Preferably, each of the support members is a purlin or a rafter.

The support members may have any suitable profile. Preferably, the profile of each of the support members includes a lower portion for supporting the cross members. The lower portion is preferably in the form of a lower panel. The profile of each of the support members preferably includes an upper portion for supporting the roof panel. The upper portion is preferably in the form of an upper panel. In a particular preferred form, each of the support members has a substantially Z-shaped profile which includes the lower portion, the upper portion, and an intermediate portion which extends between the lower portion and the upper portion. The intermediate portion is preferably in the form of an intermediate panel. The intermediate portion is preferably substantially perpendicular with respect to the lower portion and the upper portion.

The support members may be made from any suitable material. Preferably, the support members are made from metal. For example, the support members may be made from steel or a steel alloy. In a particular preferred form, the support members are made from sheet metal.

The rigidity and strength of the roof structure may be further increased if the structure also comprises a plurality of fasteners which secure at least some of the bridge members relative to each other. The fasteners may be of any suitable type. In a particular preferred form, the fasteners are screws. For example, the fasteners may be "Tek" screws, or any other suitable type of screw.

The bridge members may be made from any suitable material. Preferably, the bridge members are made from metal. For example, the bridge members may be made from steel or a steel alloy. In a particular preferred form, the bridge members are made from sheet metal.

The roof structure may include any suitable number of bridge members. Preferably, the more bridge members which the roof structure includes, the more rigid the roof structure, and vice versa.

The bridge members are preferably spaced apart from each other. The amount by which the bridge members are spaced apart from each other influences the rigidity and strength of the roof structure such that the smaller the amount, the greater the rigidity and strength of the roof structure, and vice versa. It is preferred that the bridge members are laterally spaced apart from each other at regular intervals. The bridge members have centres which are preferably spaced apart from each other at intervals of 20 mm to 3,000 mm. In a particular embodiment, the centres of the cross members are spaced apart from each other at regular intervals of 1,200 mm.

The safety barrier which is secured relative to the bridge members may be of any suitable type. For example, the safety barrier may be in the form of safety mesh or net. In a particular preferred form, the barrier comprises a plurality of separate wires which are secured to and which extend between the bridge members.

The insulating layer may be provided by any suitable type of insulation. Preferably, the insulating layer is provided by a layer of thermal insulation.

The roofing layer may be of any suitable type. Preferably, the roofing layer may be provided by one or more roof panels or sheets. For example, the roofing layer may be provided by one or more sheet metal panels.

The air gap which separates the roofing layer and the insulating layer from each other may be any suitable size. The air gap is preferably 50 mm-300 mm wide. Preferably, the width of the air gap complies with Section J of the BCA. In a particular preferred form, the air gap is 100 mm wide.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S)

Figures 1, 2:
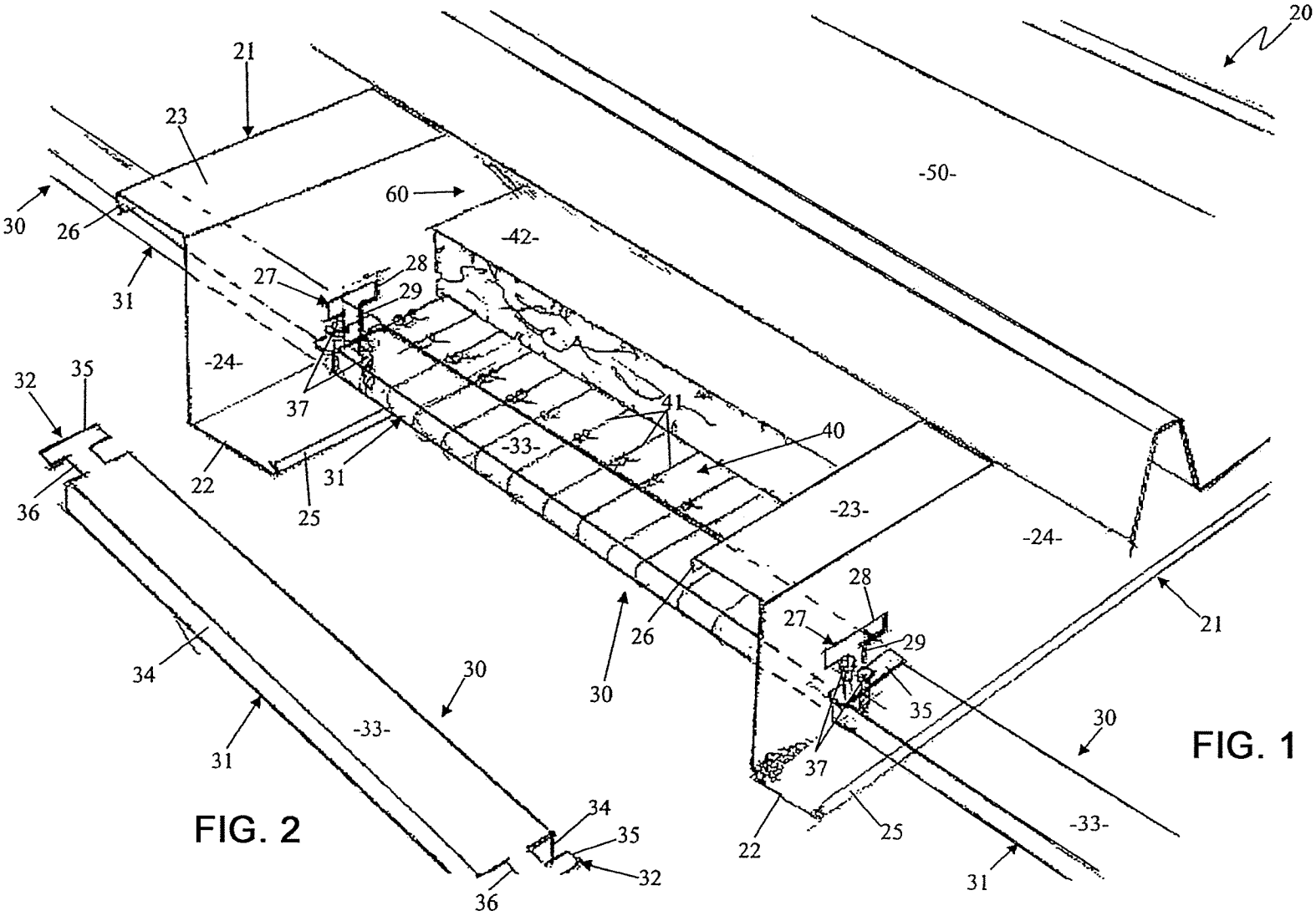
FIG. 1 is a perspective view of a roof structure.
FIG. 2 is a perspective view of a bridge member of the roof structure.

Referring to the figures, a roof structure 20 comprises a plurality of adjacent support members in the form of purlins 21. Purl ins 21 are parallel to each other, and are spaced apart from each other at regular or irregular intervals.

Each purlin 21 is made from sheet metal, and has a Z-shaped profile comprising a lower portion in the form of a lower panel 22, an upper portion in the form of an upper panel 23, and a vertical intermediate portion in the form of an intermediate panel 24 which extends between the lower panel 22 and the upper panel 23, and which is perpendicular with respect to the lower panel 22 and the upper panel 23. A lip 25 extends upwardly from the lower panel 22, and is perpendicular with respect to the lower panel 22. A lip 26 extends downwardly from the upper panel 23, and is perpendicular with respect to the upper panel 23.

A plurality of T-shaped openings 27 are punched into the intermediate panel 24 of each purl in 21. Openings 27 are spaced apart from each other at regular intervals along the length of the purlins 21. FIG. 1 only shows one of the openings 27 in each of the purlins 21. Each opening 27 includes a first portion 28 and a second narrower portion 29 which adjoins the first portion 28.

A plurality of bridge members 30 are spaced apart from each other at regular intervals and extend laterally between each pair of adjacent purlins 21 such that the bridge members 30 are perpendicular with respect to the purlins 21.

Each bridge member 30 is made from sheet metal, and includes an intermediate portion 31 and a pair of end portions 32 which extend from the intermediate portion 31. Intermediate portion 31 includes a top panel 33 and a pair of side panels 34 which extend perpendicularly from the top panel 33. Each end portion 32 is provided by the top panel 33, and includes a head portion 35 and a narrower neck portion 36 which extends from the head portion 35.

The end portions 32 of the bridge members 30 are each received by the openings 27 in the purlins 21. The side panels 34 of each bridge member 30 are supported by the lip 25 of one of the purlins 21 which the bridge member 30 extends between.

In order to insert the end portion 32 of a bridge member 30 into one of the openings 27, the head portion 35 and the neck portion 36 of the end portion 32 are inserted into the first portion 28 of the opening 27 so that the neck portion 36 is located above the second portion 29 of the opening 27. The neck portion 36 is then lowered into the second portion 29. The width of the second portion 29 is such that the head portion 35 is inhibited from being withdrawn from the opening 27.

The end portion 32 is able to be removed from the opening 27 by firstly raising the end portion relative to the opening 27 so that the neck portion 36 is located in the first portion 28. The head portion 35 and the neck portion 36 are then able to be withdrawn from the first portion 28 of the opening 27.

Figure 3:
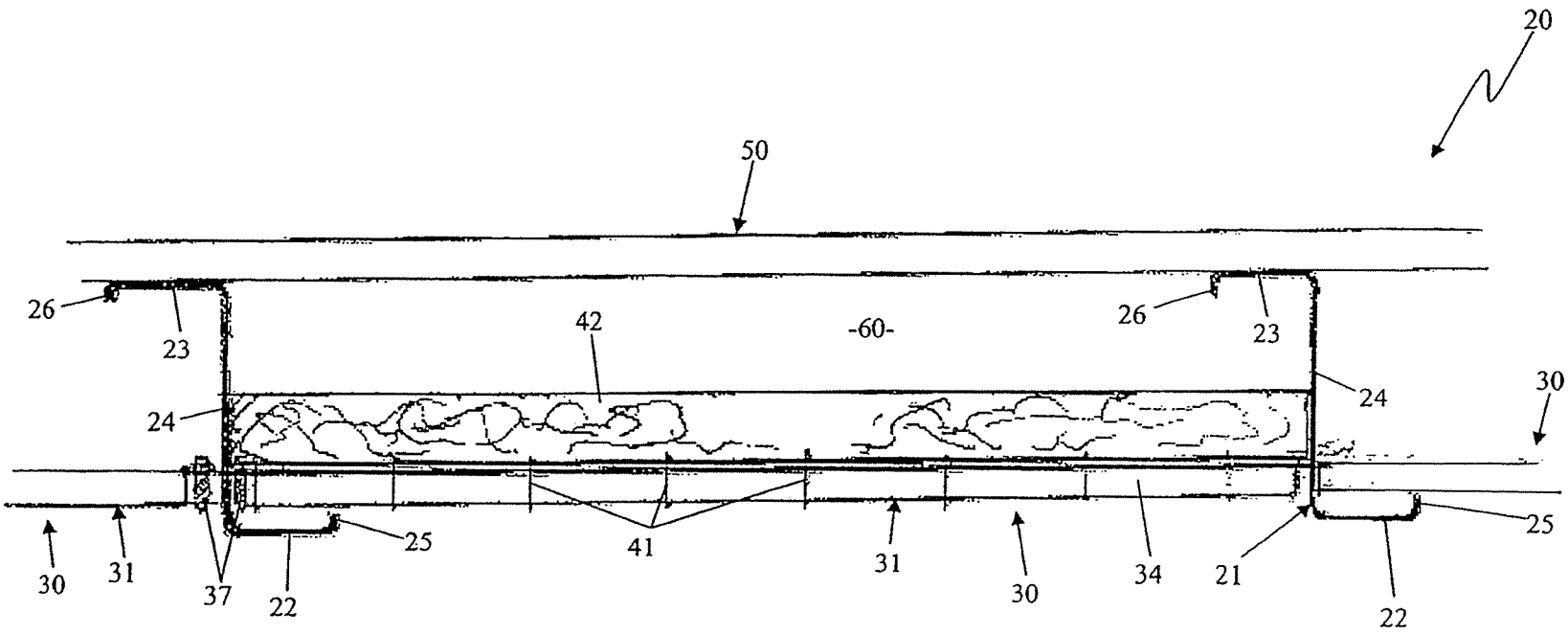
FIG. 3 is an end view of the roof structure.

Each opening 27 is able to receive an end portion 32 of two bridge members 30 as shown in FIGS. 1 and 3. The end portion 32 of one of the bridge members 30 which is received by a particular opening 27 overlies the other bridge member 30 which is received by that opening 27. In particular, the head portion 35 of the overlying end portion 32 lies on top of the top panel 33 of the other bridge member 30 which is received by the opening 27. The end portions 32 of the two bridge members 30 which are received by the opening 27 are secured together with fasteners which are in the form of 12×25 "Tek" screws 37.

A safety barrier 40 for preventing a person from falling off the roof structure 20 is secured relative to the bridge members 30 of the roof structure 20 as shown in FIGS. 1 and 3. Barrier 40 comprises a plurality of individual safety wires 41 which extend between adjacent bridge members 30. Wires 41 are secured to the bridge members 30 by wrapping or looping their ends around the bridge members 30 and then twisting the ends around the wires 41 as depicted in FIG. 1.

The bridge members 30 and the safety barrier 40 support an insulating layer which is provided by thermal insulation 42. Insulation 42 may be any suitable type of insulation. For example, insulation 42 may be fiberglass or wool insulation.

A roofing layer provided by one or more ribbed roof panels or sheets 50 is supported by the purlins 21 such that the sheets 50 rest on the upper panels 23 of the purlins 21. Roof sheets 50 and the insulation 42 are separated from each other by an air gap 60 which is 100 mm wide.

A method of building the roof structure 20 is now briefly described. The method comprises the steps of:

(i) extending a plurality of bridge members 30 laterally between a plurality of adjacent purlins 21 such that the end portions 32 of the bridge members 31 are received by the openings 27 in the purlins 21 such that the end portions 31 can be inhibited from being withdrawn from the openings 27;

(ii) supporting the safety barrier 40 with the bridge members 30;

(iii) supporting the insulating layer 42 with the safety barrier 40; and (iv) supporting the roofing layer 50 with the purlins 21 such that the roofing layer 50 and the insulating layer 42 are separated from each other by the air gap 60.

Figure 4:
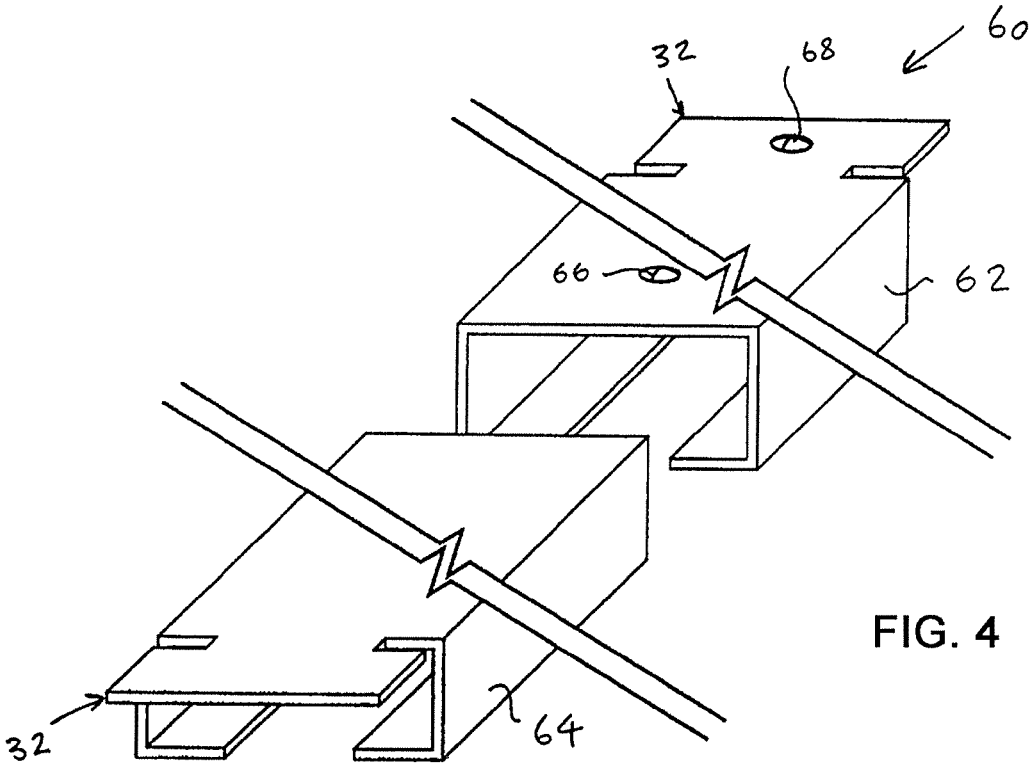
FIG. 4 is a perspective view of a telescopic bridge member of another roof structure with parts separated.
Figure 5:
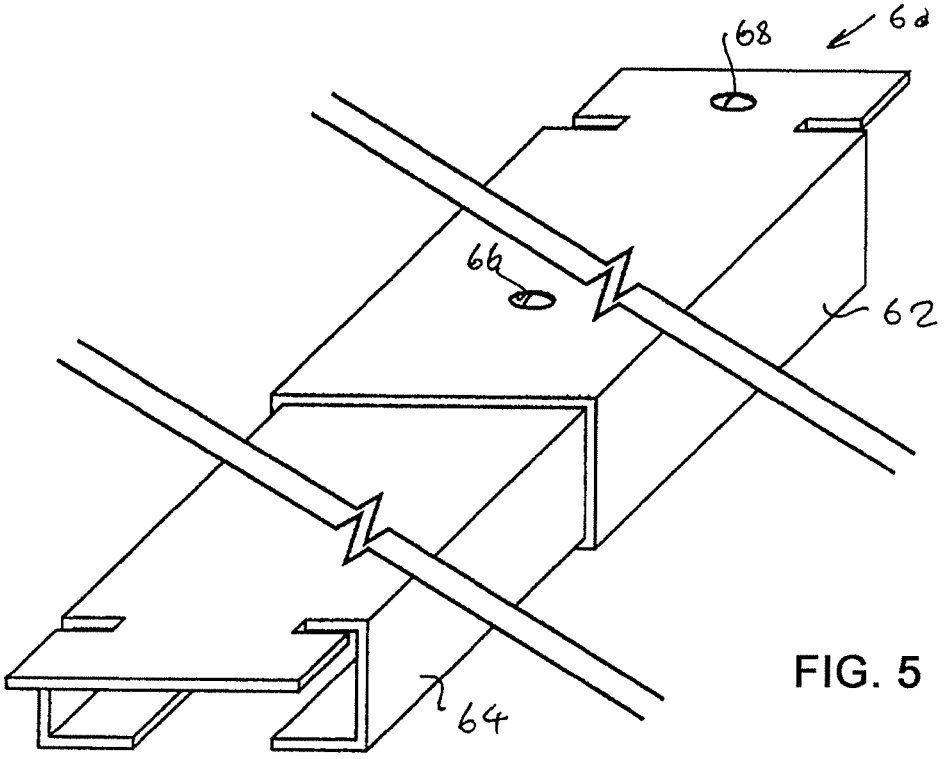
FIG. 5 is a perspective view of the telescopic bridge member of FIG. 4 with parts engaged.
Figure 6:
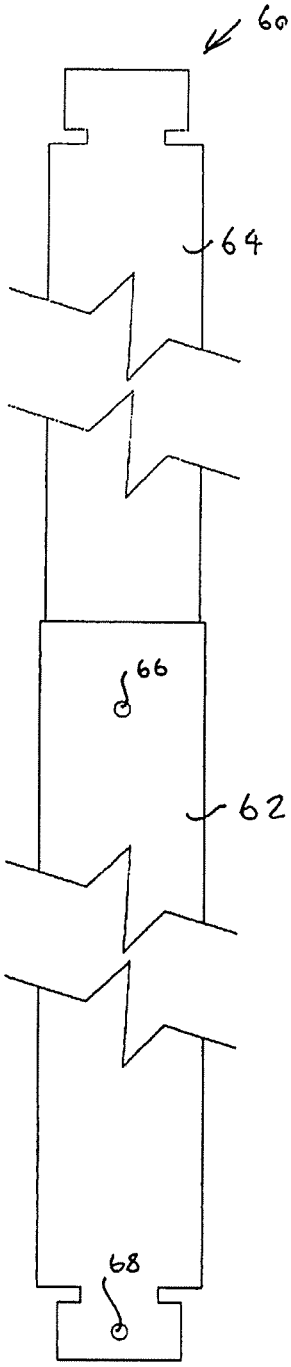
FIG. 6 is a top view of the telescopic bridge member of FIG. 5.
Figure 7:
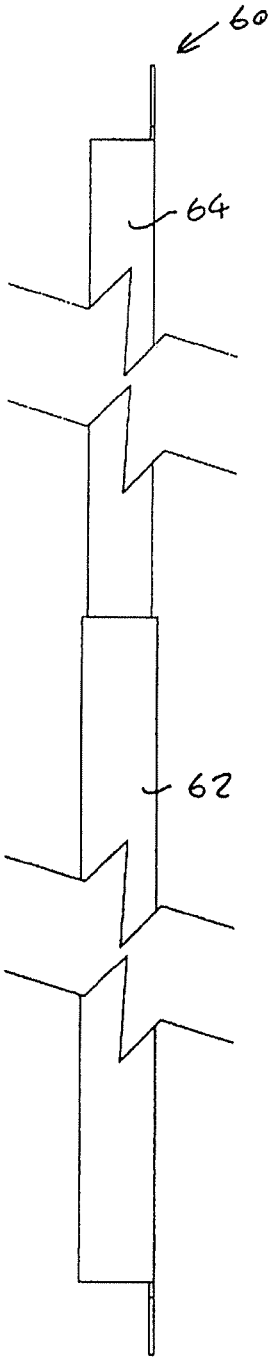
FIG. 7 is a side view of the telescopic bridge member of FIG. 5.
Figure 8:
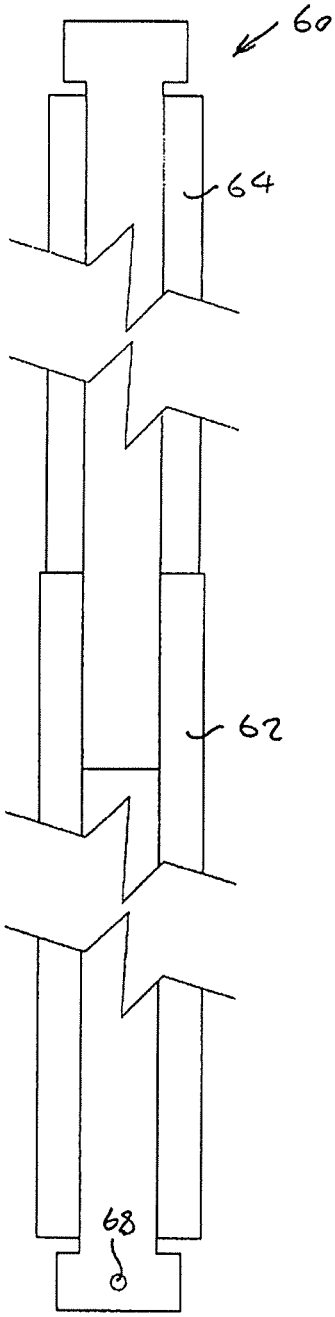
FIG. 8 is a bottom view of the telescopic bridge member of FIG. 5.
Figure 9:
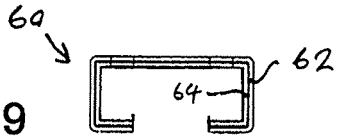
FIG. 9 is an end view of the telescopic bridge member of FIG. 5.

Turning to FIG. 4, each bridge member 30 can be replaced by a telescopic bridge member 60 including two generally C-shaped body parts 62, 64 (see also FIG. 9). The bridge member 60 is substantially rigid and comprises an intermediate portion formed by the overlapping body parts 62, 64, and a pair of end portions 32 located at opposite ends of the intermediate portion. Each end portion 32 (as previously described) is adapted to be received by an opening 27 in a purlin 21 such that the end portion 32 can be inhibited from being withdrawn from the opening 27. The rigid bridge members 60 can be used to space a plurality of the purlins 21 apart from each other at regular intervals, and for maintaining the spacing between the purlins 21.

Each body part 62, 64 is of a similar construction. However, as can best be seen in FIGS. 5 to 8, body part 64 is dimensioned so as to be snugly slid within body part 62. Body part 64 defines a threaded fastening hole 66 for receiving a grub screw to fixedly fasten the movable parts 62, 64 together. In addition, one of the end portions 32 may define another fastening hole 68 in which a "Tek" screw 37 can be received when fastening end portions 32 of serially arranged bridge members 60 together.

Figure 10:
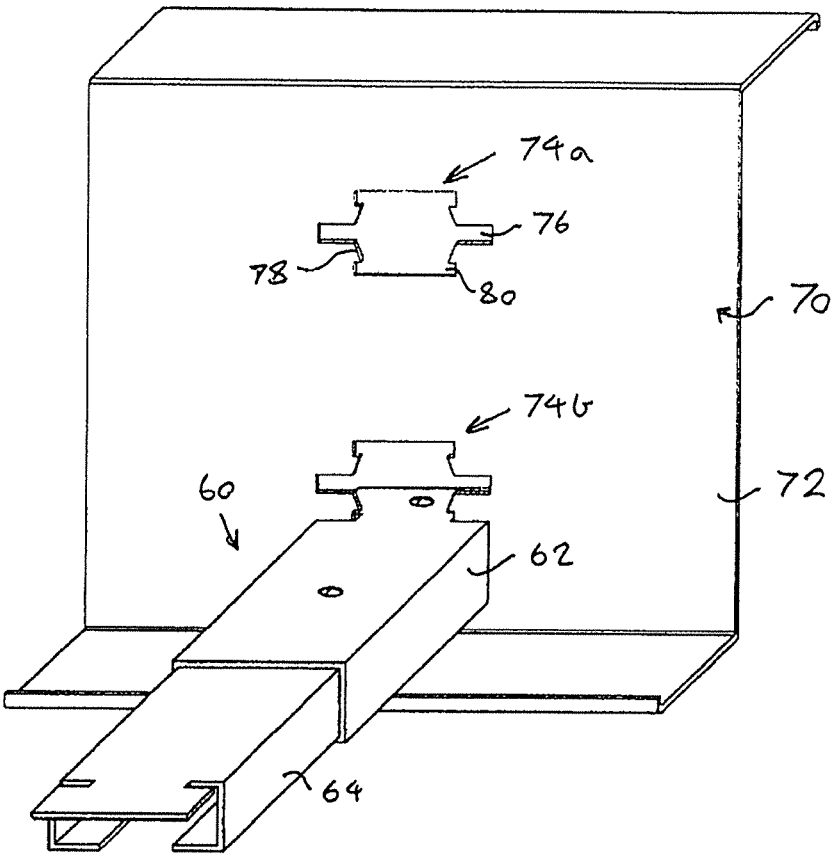
FIG. 10 is a partial perspective view of the telescopic bridge member of FIG. 5 engaging with a purlin.

Turning to FIG. 10, there is provided another purlin 70 with an intermediate panel 72. The purlin 70 is rotationally symmetric and defines a pair of symmetric openings 74*a*, 74*b* so that the purlin 70 has the same characteristics when mounted in either orientation, 180° apart. Each opening 74 defines a central portion 76 through which an end portion 32 is initially received. A pair of walls 78 taper downwardly to guide the neck portion 36 of the bridge member 60, and resiliently reciprocate to lock the bridge member 60 in a bottom recess 80 of the opening 74.

Figure 11:
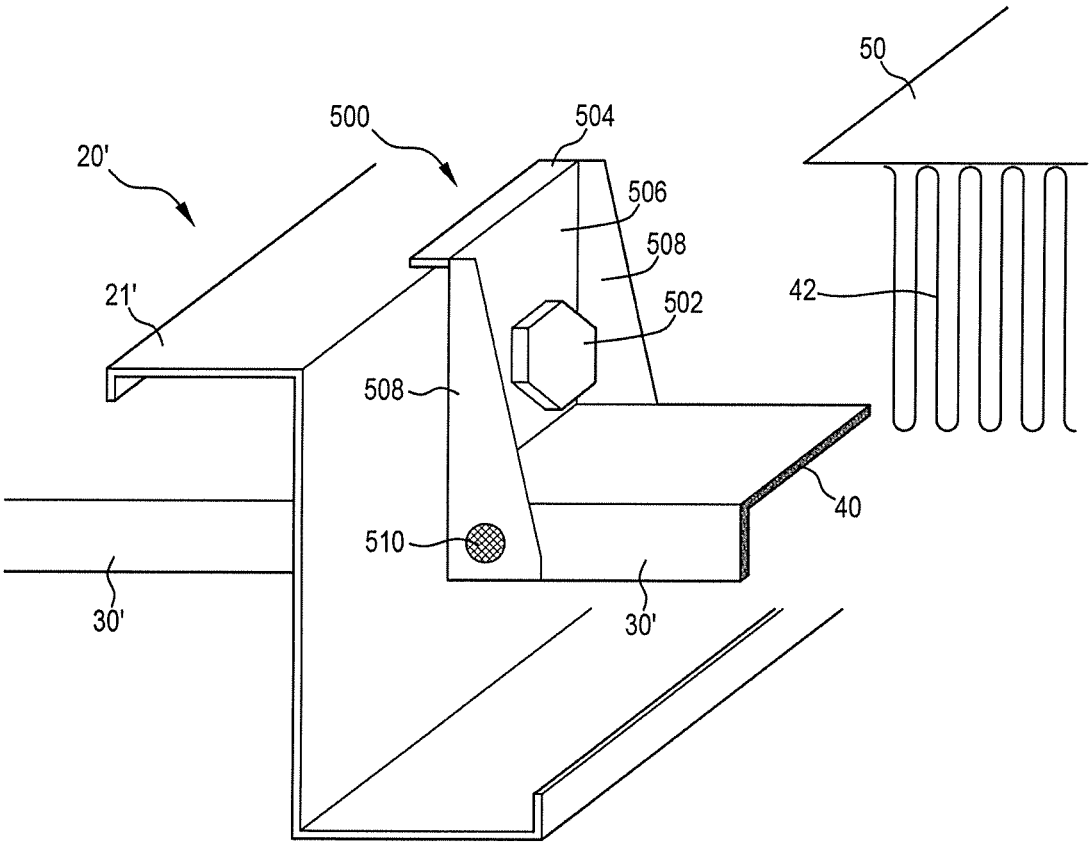
FIG. 11 is a perspective view of an alternative roof structure in accordance with an embodiment of the present invention.

According to an embodiment of the present invention, there is provided a roof structure 20' as shown in FIG. 11. Like reference numerals refer to like features previously described.

The roof structure 20' includes support members in the form of purlins 21'. Depth locators 500 are fastened to the purlins 21' to locate a desired depth of bridge members 30' and therefore insulation 42. The bridge members 30' extend between the purlins 21' at the desired depth. A mesh safety barrier 40' is supported by the bridge members 30'.

Each depth locator 500 is in the form of a folded sheet bracket which advantageously resists twisting when fastened to the purlins 21' with a threaded depth locator bolt 502 (i.e. fastener) driven by a rattle gun. Steel fabricators have rattle guns on hand and can readily drive the bolts 502 which are tightened with nuts that can induce twisting.

Each depth locator 500 includes an upper lip 504 for aligning with the horizontal roof of the purlin 21'. Each depth locator 500 further includes a back 506 for aligning with the vertical wall of the purlin 21', and a pair of flanges 508 extending from either side of the back 506. The flanges 508 receive a bridge member 30' that is located at the base of the depth locator 500 which is desired depth of bridge members 30'. Not only does the depth locator 500 resist the twisting when tightening the bolts 502, but the base of the flanges 508 also provide the desired depth of bridge members 30' and therefore insulation 42.

Figure 12A:
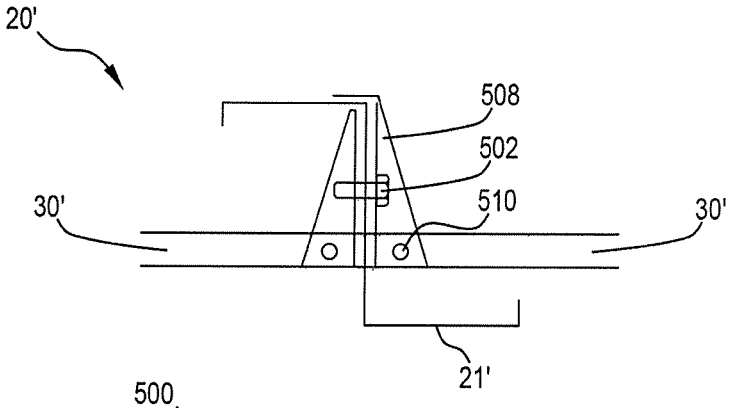
FIG. 12*a* is a side sectional view of the roof structure of FIG. 11.

The structure 20' further includes a pair of bridge rivets 510 (i.e. fasteners) extending through respective flanges 508 to fasten the bridge member 30' to a depth locator 500 (see also FIG. 12*a*).

Figure 12B:
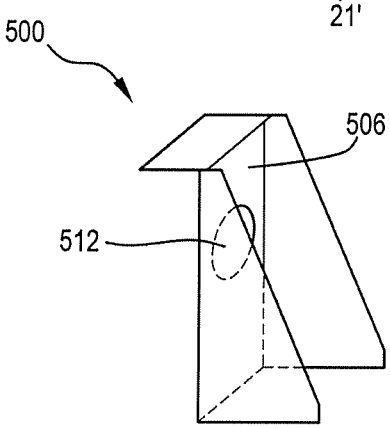
FIG. 12*b* is a front perspective view of a depth locator of the roof structure of FIG. 11.
Figure 12C:
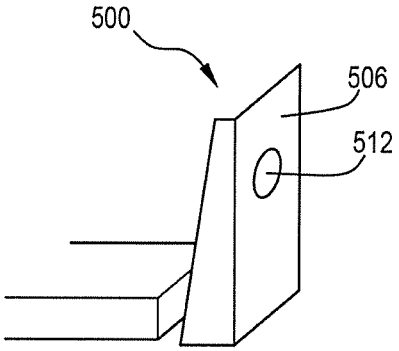
FIG. 12*c* is a rear perspective view of a depth locator of the roof structure of FIG. 11.
Figure 12D:
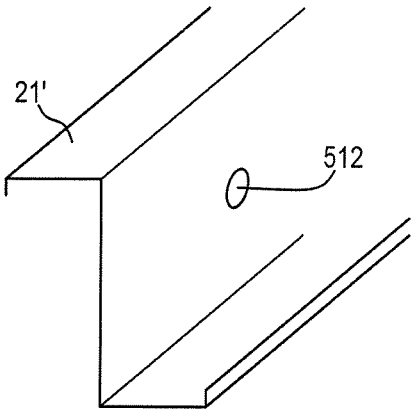
FIG. 12*d* is a perspective view of a purlin support member of the roof structure of FIG. 11.

The depth locator backs 506 of the two depth locators 500 shown in FIGS. 12*b* and 12*c*, and the purlin 21' shown in FIG. 12*d* sandwiched there-between, define three co-incident holes 512 for receiving the depth locator bolt 502.

Throughout the specification and the claims, unless the context requires otherwise, the term "comprise", or variations such as "comprises" or "comprising", will be understood to apply the inclusion of the stated integer or group of integers but not the exclusion of any other integer or group of integers.

Throughout the specification and claims, unless the context requires otherwise, the term "substantially" or "about" will be understood to not be limited to the value for the range qualified by the terms.

It will be appreciated by those skilled in the art that variations and modifications to the invention described herein will be apparent without departing from the spirit and scope thereof. The variations and modifications as would be apparent to persons skilled in the art are deemed to fall within the broad scope and ambit of the invention as herein set forth.

It will be clearly understood that, if a prior art publication is referred to herein, that reference does not constitute an admission that the publication forms part of the common general knowledge in the art in Australia or in any other country.

Thus, having described the invention, what is claimed is:

1. A roof structure comprising:

support members;

depth locators configured to be fastened to the support members to locate a desired depth of bridge members;

the bridge members configured to extend between the support members at the desired depth; and a safety barrier configured to be supported by the bridge members, wherein each depth locator includes a back configured to align with a vertical wall of a respective support member, the back being in substantial contact with the vertical wall when the depth locator is fastened to the respective support member, and wherein each depth locator includes a lip configured to align with a roof of a support member.

2. A roof structure as claimed in claim 1, wherein each depth locator includes a folded sheet bracket which advantageously resists twisting when fastened to the support members with a threaded depth locator fastener driven by a rattle gun.

3. A roof structure as claimed in claim 1, wherein each depth locator includes a pair of flanges extending from either side of the back.

4. A roof structure as claimed in claim 3, wherein the pair of flanges are configured to receive one of the bridge members.

5. A roof structure as claimed in claim 3, wherein the back and the support member define co-incident holes for receiving a depth locator fastener.

6. A roof structure as claimed in claim 5, wherein the depth locator fastener includes a bolt.

7. A roof structure as claimed in claim 3, wherein the structure further includes a pair of bridge fasteners extending through the flanges to fasten a bridge member to a depth locator.

8. A roof structure as claimed in claim 7, wherein each bridge fastener includes a rivet.

9. A roof structure as claimed in claim 1, wherein a safety barrier is supported by the bridge members and an insulating layer rests directly on the safety barrier.

10. A roof structure as claimed in claim 1, further including a supported roofing layer.

11. A roof structure as claimed in claim 10, wherein the roofing layer and the insulating layer are separated from each other by an air gap.

12. A roof-structure depth-locator for configured to be fastened to a support member to locate a desired depth of a bridge member, the depth-locator including:

a back configured to align with a vertical wall of the support member, the back being in substantial contact with the vertical wall when the depth locator is fastened to the support member, and a lip configured to align with a roof of a support member.

13. A method of building a roof structure, the method comprising the steps of:

(i) extending bridge members between adjacent support members at a desired depth located by depth locators fastened to the support members; and (ii) supporting a safety barrier with the bridge members, wherein each depth locator includes a back configured to align with a vertical wall of a respective support member, the back being in substantial contact with the vertical wall when the depth locator is fastened to the respective support member, and wherein each depth locator includes a lip configured to align with a roof of a support member.

14. A method of building a roof structure as claimed in claim 13, the method comprising:

(iii) supporting an insulating layer with the safety barrier.

15. A method of building a roof structure as claimed in claim 14, the method further involving:

(iv) supporting a roofing layer with the support members such that the roofing layer and the insulating layer are separated from each other by an air gap.

* * * * *